United States Patent [19]

Isozumi et al.

[11] Patent Number: 4,853,570

[45] Date of Patent: Aug. 1, 1989

[54] COAXIAL ENGINE STARTER WITH HOLLOW SHAFT CLUTCH

[75] Inventors: Shuzoo Isozumi; Toshinori Tanaka, both of Hyogo, Japan

[73] Assignee: Mitsubishi Denki Kabushiki Kaisha, Japan

[21] Appl. No.: 146,924

[22] Filed: Jan. 22, 1988

[30] Foreign Application Priority Data

Jan. 23, 1987 [JP] Japan ..... 62-14354
Feb. 5, 1987 [JP] Japan ..... 62-26581

[51] Int. Cl.[4] ..... H02K 7/10

[52] U.S. Cl. ..... 310/78; 310/43; 310/89

[58] Field of Search ..... 310/78, 112, 40 MM, 310/43, 87, 154, 89, 156; 74/7 R, 7 C, 7 E; 290/48

[56] References Cited

U.S. PATENT DOCUMENTS 4,327,300 4/1982 Hoven ..... 310/78
4,357,552 11/1982 MacMillan ..... 310/43
4,553,441 11/1985 Hamano et al. .
4,760,274 7/1988 Isozumi ..... 74/7 E

FOREIGN PATENT DOCUMENTS 2339195 2/1975 Fed. Rep. of Germany .
2448069 4/1976 Fed. Rep. of Germany .
7835723 7/1979 France .

*Primary Examiner*—Patrick R. Salce
*Assistant Examiner*—D. L. Rebsch
*Attorney, Agent, or Firm*—Sughrue, Mion, Zinn, Macpeak & Seas

[57] ABSTRACT

An engine starter includes an electric motor having a hollow rotary shaft for causing a turning force to start an engine, a hollow inner clutch rotatably supported in the hollow rotary shaft through a one-way clutch, a pinion shaft provided with a pinion which is engaged with a ring gear of the engine, a spline-fitted in the hollow inner clutch to move in the axial direction thereof, an electromagnetic switch attached to one end of the electric motor for turning on or off the electric motor, and a moving body which moves in conjunction with the electromagnetic switch to move the pinion shaft in the axial direction thereof to engage the pinion with the ring gear.

9 Claims, 3 Drawing Sheets

COAXIAL ENGINE STARTER WITH HOLLOW SHAFT CLUTCH

BACKGROUND OF THE INVENTION

1. Field Of The Invention

The present invention relates to an engine starter, and particularly to an engine starter of a coaxial type for a vehicle.

2. Prior Art

FIG. 1 shows a conventional starter 200 for the engine of a vehicle. The starter 200 comprises a DC motor 202, an overrunning clutch mechanism 106 slidably fitted on the extended portion 102*a* of the rotary shaft 102 of the armature of the DC motor, a front bracket 114 also serving as a bearing for the end of the extended portion of the rotary shaft, and a shift lever 117. One end of the shift lever 117 is engaged with a plunger rod 207 of an electromagnetic switch 118 provided alongside the DC motor for purposes of sliding the overrunning clutch mechanism 106 on the extended portion of the rotary shaft 102. The other end of the shift lever 117 is engaged with an annular member 208 attached to the overrunning clutch mechanism.

An armature 100 of the DC motor comprises a core 101, the rotary shaft 102 of the armature, a commutator 103 fitted to the rear portion of the rotary shaft, and an armature coil 104 wound on the core and connected to the commutator. A helical spline 105 is provided in the rotary shaft 102 in front of the armature core 101 and fitted with the overrunning clutch 106. Brushes 107 are supported in contact with the commutator 103 by brush holders 108 and secured to a rear bracket 109 by bolts 110. A bearing 111 is provided between the rear bracket 109 and the rear end portion of the rotary shaft 102. The overrunning clutch 106 includes an outer member 106*a*, rollers 106*b*, a pinion 106*c* for engaging a ring gear of an engine and supported on the rotary shaft 102 by a sleeve bearing 106*d* fitted on the inside surface of the pinion, and a cover 106*e* covering the body of the over-running clutch. The pinion 106*c* is slidable in the axial direction of the rotary shaft 102. A stopper 112 is provided on the rotary shaft 102 so that the pinion 106*c* comes into contact with the stopper when being moved forward. A sleeve bearing 113 is attached to the inside surface of the front end portion of the front bracket 114 and supports the rotary shaft 102 at the front end thereof. A plurality of permanent magnets 116, which function as a field for the armature 100, are secured to the inside surface of a yoke 115 provided to form a magnetic circuit and constitute a casing. The ends of a plastic level 117 are engaged with the plunger 119 of an electromagnetic switch 118 and the peripheral portion of the overrunning clutch 106. A movable contact 120 is attached to a rod 122 by an electric insulator 121. The rod 122 is inserted in a core 123 so that the rod is slidable back and forth along its axis. A fixed contact 124 is secured to a cap 125 made of an electric insulator. A driving coil 126 for moving the plunger 119 is wound on a plastic bobbin 127 and housed in a case 128. A lead wire 129 connects the fixed contact 124 and the corresponding brush 107 to each other. A return spring 130 is provided between the core 123 and the plunger 119.

The operation of the conventional engine starter will now be described. When an ignition switch is closed, the driving coil 126 of the electromagnetic switch 118 is supplied with electricity to move the plunger 119 backward (toward the rod 122) to push the rod 122 backward and bring the movable contact 120 in touch with the fixed contact 124. As a result, electricity is applied to the armature 100 through the fixed contact 124, the lead wire 129 and the brush 107 to rotate the armature. The turning force of the armature 100 is transmitted to the overrunning clutch 106 through the helical spline 105 of the peripheral portion of the rotary shaft 102 to rotate the pinion 106*c*. Since the plunger 119 is moved backward, the lever 117 is turned counterclockwise to slide the overrunning clutch 106 forward to engage the pinion 106*c* with the ring gear secured to a flywheel attached to the crankshaft of the engine.

Immediately after the engine is started, only the pinion 106*c* is moved together with the ring gear because of the one-way overrunning action of the overrunning clutch 106, so that the pinion races.

When the ignition switch is opened after starting the engine, the driving coil 126 is deenergized to return the plunger 119 to the original position thereof by the force of the return spring 130 in the electromagnetic switch 118 and also return the overrunning clutch 106 to its original position. Consequently, the engine starter stops.

However, the conventional starter 1 thus constituted has a disadvantage in that it needs the shift lever 117 for sliding the overrunning clutch mechanism 106 on the extended portion 102*a* of the rotary shaft 102. The conventional starter 1 has another disadvantage that the layout of the engine in the vehicle is severely restricted because the electromagnetic switch 118 for operating the shift lever 117 and applying electricity to the DC motor 202 is placed alongside the DC motor which results in a two-axial type starter. The conventional starter 1 has still another disadvantage that assembly is difficult, because the weight of the starter is heavy and the number of component parts thereof is large.

Since the electromagnetic switch 118 and the DC motor are disposed in parallel with each other in the conventional engine starter, it is necessary to allocate a space in the engine or in a vehicle or the like to house the electromagnetic switch so that the engine starter can be attached to the engine. For that reason, there is a problem that the layout of the engine in the vehicle or the like is restricted.

If the electromagnetic switch 118 and the DC motor are simply disposed in series with each other in order to solve the problem, the total length of the engine starter is increased to make it difficult to lay out the engine at the rear portion of the engine starter. This is another problem.

If the overrunning clutch, which is separately constructed, the driving coil of the electromagnetic switch and so forth are placed in the armature in order to solve the former problem, it is difficult to secure a good assembling property and a sufficient processing accuracy and properly form the magnetic circuit to attain satisfactory performance and quality. This is still another problem.

SUMMARY OF THE INVENTION

It is an object of the present invention to provide an engine starter which eliminates the above-described disadvantages.

It is another object of the present invention to provide an engine starter, the size and weight of which are reduced and the number of component parts of which is decreased.

It is a further object of the present invention to provide an engine starter which performs well and has an electromagnetic (EM) switch and an electric motor disposed in series with each other to make the total length of the engine starter small enough to improve the assembling property thereof to an engine.

The engine starter according to the present invention includes an electric motor having a hollow rotary shaft, a hollow inner clutch member which is supported in the hollow rotary shaft by a one-way clutch mechanism, a pinion shaft spline-fitted in the hollow inner clutch member, an EM switch attached to one end of the electric motor to turn the motor on and/or off, and a moving body, which is moved in conjunction with the action of the EM switch to move the pinion shaft. The one-way clutch mechanism is provided in the hollow rotary shaft of the electric motor. The pinion shaft is provided in the one-way clutch mechanism. The pinion shaft is moved by the moving body which is moved in conjunction with the action of the electromagnetic switch.

The electric motor and the EM switch are disposed in series with each other to make the total length of the engine starter small enough to render the engine starter compact and symmetric with regard to an axis thereof. As a result, the assembling property of the engine starter to the engine and the quality of the engine starter are good.

The engine starter according to the present invention includes a DC motor whose armature has a hollow rotary shaft provided in a cylindrical yoke constituting a flux path, a rotary output shaft supported in the hollow internal opening of the hollow rotary shaft so that the rotary output shaft is slidable in the axial direction thereof and receives a turning force from the hollow rotary shaft through an overrunning clutch mechanism, an EM switch attached to one end of the DC motor to move the rotary output shaft and apply electricity to the DC motor, and a front bracket secured to the end of the yoke opposite the EM switch when the front bracket is molded from plastic.

Since the electromagnetic switch is located at the end of the DC motor coaxially therewith and the rotary output shaft is slidably supported in the hollow rotary shaft of the armature, the total length of the engine starter is decreased to greatly reduce the length of the yoke. Since moments which cause high stress in the front bracket do not act between the bearing portion of the front bracket and its surface attached to an engine, the thickness of the front bracket can be decreased. The reduced thickness makes it possible to secure the front bracket to the end of the yoke when molding the front bracket from plastic to embed the end of the yoke positioned in a molding die. The front bracket and the yoke can thus be integrally coupled to each other to substantially reduce the number of component parts of the engine starter and greatly diminish the total weight of the engine starter.

DETAILED DESCRIPTION OF THE PREFERRED EMBODIMENTS

The embodiments of the present invention will be hereafter described in detail with reference to the drawings attached hereto.

Figure 2:
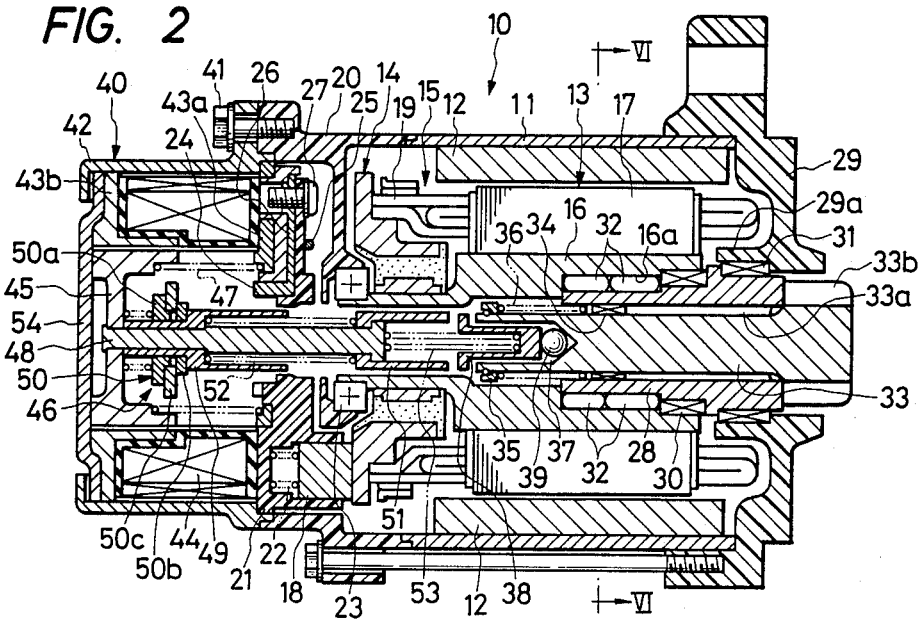
FIG. 2 is a sectional view showing an engine starter according to an embodiment of the present invention.

FIG. 2 shows an engine starter 10 which is one of the embodiments and of the coaxial type in which an electromagnetic (EM) switch located at one end of a DC motor 15 to communicate a hollow rotary shaft of an armature of the DC motor and a plunger rod of the EM switch coaxially with each other, and extend the plunger rod to the rotary output shaft through the internal opening of the hollow rotary shaft of the armature and shape the engine starter as a slender cylinder. The DC motor 15 is chiefly composed of permanent magnets 12 secured at circumferential intervals to the inside circumferential surface of a yoke 11 provided to form a magnetic circuit and constitute a casing. The armature 13 is rotatably supported in the center of the yoke, and a face-contact-type disc commutator 14 is provided at one end of the armature.

Figure 1:
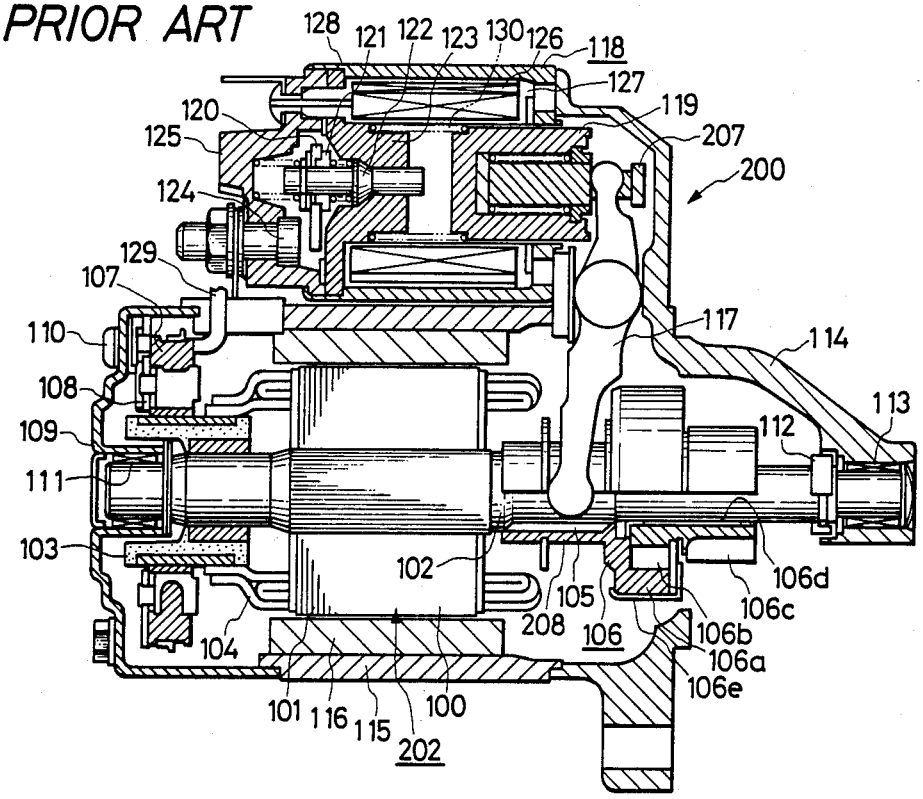
FIG. 1 PRIOR ART
FIG. 1 is a sectional view showing a conventional engine starter.

The armature 13 includes the hollow rotary shaft 16 and a core 17 mounted on the peripheral portion of the hollow rotary shaft. The inside circumferential surface of the hollow rotary shaft 16 has a recess having a plurality of cam surfaces **16*a* at circumferential intervals. The disc commutator 14, which is fitted on one end portion (which is the left-hand end portion in FIG. 1) of the hollow rotary shaft 16, has a number of segments having surfaces extending perpendicularly to the axis of the hollow rotary shaft so as to slide in contact with a plurality of brushes 18 to perform commutation. The ends of an armature coil 19 wound on the armature core 17 are connected to the segments of the commutator 14**.

The brushes 18 are supported by brush holders 21 made of plastic and disposed inside a rear bracket 20 formed separately from the yoke 11 and fitted thereon. The brushes 18 are located in pressure contact with the sliding surfaces of the commutator 14 by springs 22, out of openings provided in the rear bracket 20. A bearing 23 is fitted on the inside circumferential surface of the central portion of the rear bracket 20, to support the hollow rotary shaft 16 at the rear end thereof near the commutator 14. A fixed contact 24, which is connected to a terminal (not shown), is inserted and molded in the brush holder 21. A terminal 26 to which a lead wire 25 for the brush 18 on the positive side is welded is secured to the fixed contact 24 by a screw 27.

Figure 6:
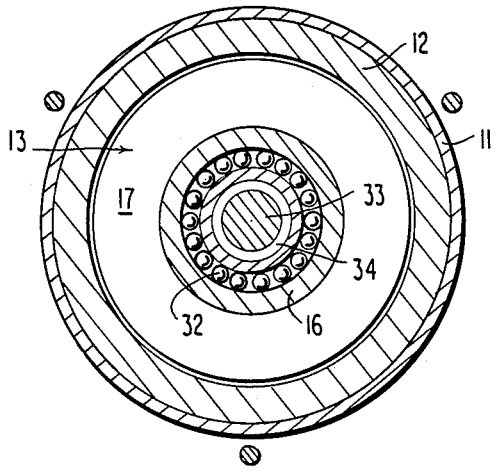
FIG. 6 is partial cross sectional view taken along the line VI—VI of FIG. 2.

An overrunning clutch mechanism is made of the cam surfaces **16*a* of the recess of the inside circumferential surface of the shaft 16. A tubular inner clutch member 28 is inserted in the internal opening of the shaft 16 so that the inner clutch member extends along the total axial length of each cam surface 16*a* of the hollow rotary shaft, and is rotatably supported by bearings 30 and 31 with respect to the hollow rotary shaft and a front bracket 29 made of plastic and attached to the front end (which is the right-hand end in FIG. 2) of the yoke 11. A plurality of openings 116 are defined by the outside circumferential surface of the inner clutch member 28 and the cam surfaces 16***a* of the recess of the hollow rotary shaft 16 of the armature 13 (see FIG. 6). Rollers 32 for coupling the cam surfaces 16*a* and the outside circumferential surface of the inner clutch member 28 to each other through engagement are disposed in the openings. Springs 32*a* (not shown) are also disposed in the openings for pushing the rollers in such a direction as to engage them with the cam surfaces and the outside circumferential surface of the inner clutch member. The openings are wedge-shaped. The overrunning clutch mechanism comprises the cam surfaces 16*a*, the inner clutch member 28, the rollers 32, the springs and so forth. The hollow rotary shaft 16 of the armature 13 is used as the outer clutch member of the overrunning clutch mechanism.

A pinion shaft 33, which is a rotary output shaft, is provided in the internal opening of the tubular inner clutch member 28. The inner clutch member 28 and the pinion shaft 33 are engaged with each other at helical splines 33*a* provided on the inside and outside circumferential surfaces of the inner clutch member and the pinion shaft. The front end of the pinion shaft 33 is integrally formed with a pinion 33*b*, which is engaged with the ring gear (not shown) of an engine. The pinion shaft 33 is supported by a bearing 34 secured to the inside surface of the inner clutch member 28 near the rear end thereof. A spring 36 for moving the pinion shaft 33 back to the original position thereof is provided between the bearing 34 and a snap ring 35 mounted on the rear end portion of the pinion shaft.

The rear end face of the pinion shaft 33 has a recess 37. A first holder 38, which has a cylindrical form and is open at one end, is movably fitted in the recess 37. A steel ball 39 is provided between the other closed end of the first holder 38 and the back surface of the recess 37 to receive a pushing force.

The engine starter 10 also has an EM switch 40 which functions to slide the rotary output shaft 33, and also functions to connect the fixed contact 24 and a movable contact 50*c* to each other in response to the closure of the ignition switch (not shown) of a vehicle to apply electricity from a battery to the DC motor 15. The EM switch 40 is coupled to the outside of the rear bracket 20 by bolts 41, and includes a driving coil 44 wound on a plastic bobbin supported by front and rear cores 43*a* and 43*b* for constituting a flux path together with a case 42, a plunger 45 slidably supported in the central opening of the bobbin, and a moving assembly 46 attached to the plunger 45. The plunger 45 is urged by a helical spring 47 provided between the plunger and the front core 43*a* so that the plunger is returned to its original position show in FIG. 2, when the ignition switch is open.

The moving assembly 46 has a rod 48 secured at one end thereof to the plunger 45 and opposed at the other end thereof to the first holder 38 located at the rear end of the pinion shaft 33. A third holder 49 having an opening toward the pinion shaft 33 is secured to the peripheral surface of the rod 48 near the plunger 45. A movable contact bearer 50 having the movable contact 50*c* pinched between two electric insulators 50*a* and 50*b* is slidably fitted on the outside circumferential surface of the third holder 49. A second holder 51 is fitted on the outside circumferential surface of the front end portion of the rod 48 so that the second holder is slidable in the axial direction of the rod. A spring 52 is provided between the second holder 51 and the inner end of the opening of the third holder 49 to push the pinion shaft 33 forward (rightward in FIG. 2). A spring 53 is provided between the front end face of the rod 48 and the inner end of the opening of the first holder 38 to push the pinion shaft 33 forward. A nonmagnetic plate 54 closes the rear end of the case 42 and serves as the rear wall of the EM switch 40 so that the plate stops the plunger 45 when it is moved back.

Since no high moment acts on the front bracket 29 of the engine starter 10, the front end plate can be made of plastic of a small thickness. Since the engine starter 10 is the coaxial type, the total length thereof is small and the axial length of the yoke 11 is therefore small. For that reason, the front bracket 29 can be molded from plastic so that one end of the yoke 11 positioned in a molding die is embedded in the plastic. At the time of molding, a holder 29*a* for the bearing 31 for supporting the inner clutch member 28 is formed integrally with the front bracket 29.

The inside surface of the hollow rotary shaft 16, clutched by the one-way clutch, is formed by quenching it without quenching a peripheral portion of the shaft.

The operation of the engine starter 10 will now be described. When the ignition switch is open, the driving coil 44 is not supplied with electricity and therefore not excited, so only the force of the spring 47 acts on the plunger 45. For that reason, the moving assembly 46 is in a posterior position, and the plunger 45 is in contact with the plate 54. Since the fixed contact 24 and the movable contact 50*c* are apart at that time, the DC motor 15 is at a standstill. In addition, the pinion shaft 33 is pushed back by the force of the spring 36.

When the ignition switch is closed, the driving coil 44 is supplied with electricity to move the moving assembly 45 forward to bring the movable contact 50*c* in touch with the fixed contact 24. As a result, electricity is applied to the armature coil 19 through the brushes 18 and the commutator 14 so that the DC motor 15 is started. In the meantime, the pinion shaft 33 is pushed forward by the springs 52 and 53 of the moving assembly 46 so that the pinion 33*b* and the ring gear secured to the peripheral portion of the flywheel of the engine are engaged with each other simultaneously with the starting of the DC motor 15. When the pinion shaft 33 and the inner clutch member 28 are rotated in the reverse direction by the ring gear faster than the hollow rotary shaft 16 of the armature 13 after starting the engine, the inner clutch member and the hollow rotary shaft are disengaged from each other so that the hollow rotary shaft races.

When the ignition switch is opened after starting the engine, the supply of electricity stops so that the moving assembly 46 is moved back together with the plunger 45 by the force of the spring 47 in the EM switch 40 and the pinion shaft 33 is moved back by the force of the spring 36.

Figure 3:
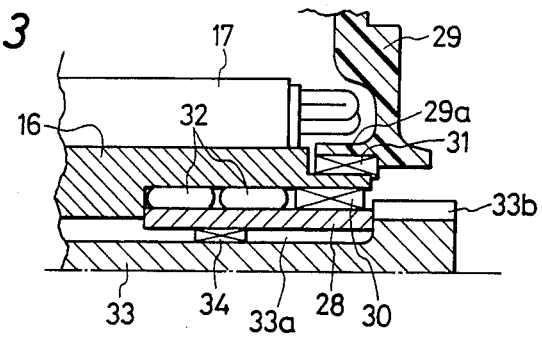
FIG. 3 is a sectional view showing the side portion of the front bracket of an engine starter according to another embodiment of the present invention.

FIG. 3 shows an engine starter according to another embodiment of the invention. In this embodiment, the hollow rotary shaft 16 of an armature is supported at the front end of the shaft by a bearing 31 fitted in a holder 29*a* formed around the central opening of a front bracket 29.

Figure 4:
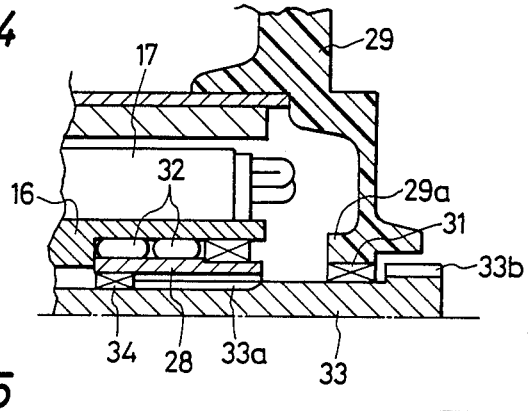
FIG. 4 is a sectional view showing the side portion of the front bracket of an engine starter according to still another embodiment of the present invention.
Figure 5:
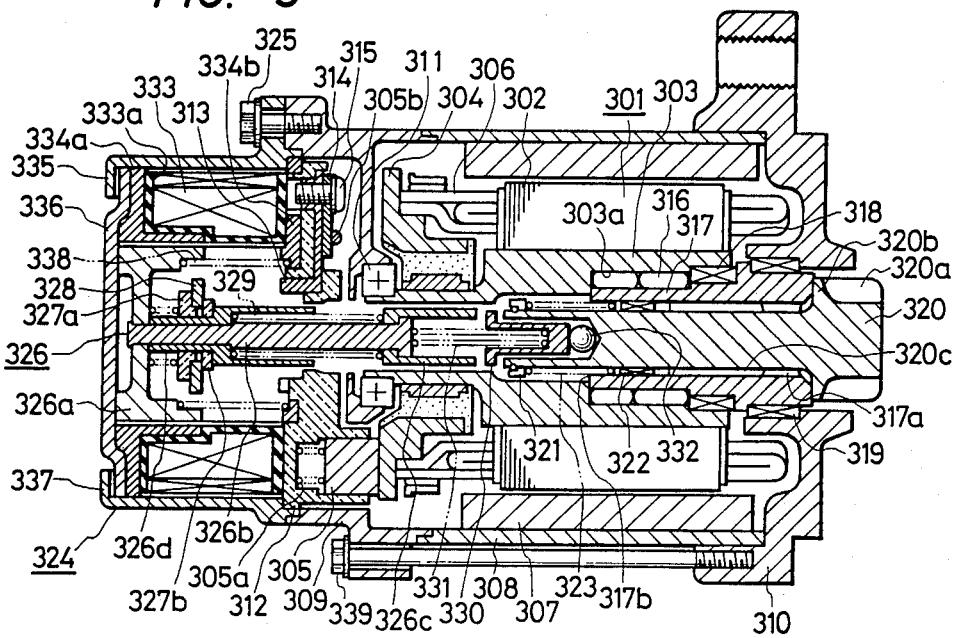
FIG. 5 is a sectional view showing an engine starter according to an embodiment of the present invention.

FIG. 4 shows an engine starter of still another embodiment. In this embodiment, a pinion shaft 33 is supported by a bearing 31 fitted in a holder 29*a* formed around the central opening of a front bracket 29.

The thickness of each of the front bracket 29 of the engine starters shown in FIGS. 3 and 4 can be also made Although the face-contact-type-commutator 304 is provided in the above-described embodiment, a different type of commutator may be provided instead.

Although the permanent magnets 307 are provided to create a flux field in the DC motor in the above-described embodiment, cores and coils wound thereon may be provided instead of the permanent magnets.

Although the pinion shaft 320 and the pinion 320*a* are integral with each other in the above-described embodiment, the pinion may be spline-fitted on the pinion shaft and provided with a stopper instead.

What is claimed is:

1. An engine starter, comprising:

electric motor means having a cylindrical yoke defining a flux path and an armature provided in said cylindrical yoke, said armature having a hollow rotary shaft therein;

rotary output shaft means for receiving a turning force, said rotary output shaft means being supported in said hollow rotary shaft and slidable in the axial direction thereof;

an overrunning clutch for applying the turning force to said rotary output shaft means form said hollow rotary shaft;

electromagnetic switch means for moving said rotary output shaft means, and for applying electricity to said electric motor means, said electromagnetic switch means being attached to one end of said electric motor means; and a bracket secured to an end of said yoke opposite said electromagnetic switch means wherein said bracket comprises plastic which is molded integrally with said yoke.

2. An engine starter as claimed in claim 1 in which said clutch means is provided in said hollow rotary shaft.

3. An engine starter for starting an engine, the starter comprising:

electric motor means having a hollow rotary shaft for transmitting a turning force to start an engine;

one-way clutch means for receiving the turning force from said hollow rotary shaft;

hollow inner clutch means rotatably supported in said hollow rotary shaft through said one-way clutch means for receiving the turning force from said one-way clutch means, wherein said one-way clutch means comprises a wedge-like cam formed on an inside surface of said hollow rotary shaft, and rollers and roller springs are each provided between said wedge-like cam and said hollow inner clutch means;

pinion shaft means provided with a pinion for receiving the turning force from said inner clutch means and transmitting it to a ring gear of said engine, and spline-fitted in said hollow inner clutch means to move in the axial direction thereof between an engagement position where said pinion is engaged with the ring gear and a non-engagement position where said pinion is disengaged from the ring gear;

electromagnetic switch means attached to one end of said electric motor means for selectively actuating and deactuating said electric motor means; and moving body means responsive to actuation of said electromagnetic switch for moving said pinion shaft in the axial direction thereof to the engagement position.

4. An engine starter as claimed in claim 3, in which a flange is provided on a portion of said pinion shaft means which projects outside of said hollow inner clutch means.

5. An engine starter as claimed in claim 3 or 4, in which said moving body means moves within said hollow rotary shaft to move said pinion shaft means.

6. An engine starter as claimed in claim 3 in which an inside surface of said hollow rotary shaft is produced by a process including quenching of said inside surface without quenching a peripheral portion thereof, and said armature core of said electric motor means is press-fitted on said peripheral portion.

7. An engine starter as claimed in claim 3 further comprising:

stopper means provided on the peripheral portion of said pinion shaft means for contacting an end of said hollow inner clutch means when said pinion shaft is moved to said engagement position; and spring means provided between said stopper means and said hollow inner clutch means for returning said pinion shaft means to said non-engagement position.

8. An engine starter as claimed in claim 3, further comprising bearing means provided between a front bracket of said electric motor means and said hollow inner clutch means.

9. An engine starter as claimed in claim 3, in which said electric motor has an armature which is provided with a face-contact-type commutator having a face in sliding contact with brushes, and said face is perpendicular to the axis of said hollow rotary shaft means.

* * * * *